US006991182B2

(12) United States Patent
Chen

(10) Patent No.: US 6,991,182 B2
(45) Date of Patent: Jan. 31, 2006

(54) SPRAYING HEAD ASSEMBLY FOR MASSAGING TUB

(75) Inventor: Jack Ya Jyue Chen, Taichung (TW)

(73) Assignee: Minh Sang Tran, Cambridge (CA)

( * ) Notice: Subject to any disclaimer, the term of this patent is extended or adjusted under 35 U.S.C. 154(b) by 241 days.

(21) Appl. No.: 10/652,820

(22) Filed: Aug. 29, 2003

(65) Prior Publication Data

US 2005/0045743 A1 Mar. 3, 2005

(51) Int. Cl.
*B05B 3/06* (2006.01)

(52) U.S. Cl. ..... 239/251; 239/261; 239/264; 239/380; 239/428.5; 4/541.5; 4/541.6

(58) Field of Classification Search ..... 239/380–383, 239/251, 261, 262, 263, 264, 263.1, 419.5, 239/428.5, 587.1, 587.4; 4/541.3, 541.4, 4/541.5, 541.6; 415/115
See application file for complete search history.

(56) References Cited

U.S. PATENT DOCUMENTS

| | | | | | |
|---|---|---|---|---|---|
| 5,056,168 | A * | 10/1991 | Mersmann | 4/541.6 |
| 5,335,376 | A * | 8/1994 | Kaldewei | 239/428.5 |
| 5,386,598 | A * | 2/1995 | Mersmann | 4/541.4 |
| 5,810,257 | A * | 9/1998 | Ton | 239/261 |
| 6,065,161 | A * | 5/2000 | Mateina et al. | 4/541.6 |
| 6,470,509 | B1 * | 10/2002 | Ayeni | 4/541.6 |

* cited by examiner

*Primary Examiner*—Steven J. Ganey
(74) *Attorney, Agent, or Firm*—Alan D. Kamrath; Nikolai & Mersereau, P.A.

(57) ABSTRACT

A spraying head assembly for a massaging tub includes a housing, a cover, a water outlet valve seat, a water outlet valve cover, a vortex rotor, a bushing, a nozzle, an impulse rotor, and a motor. Thus, the water is pressurized by rotation of the helical blades of the vortex rotor and the helical plates of the water outlet valve seat to produce a strong water beam that is injected outward from the nozzle, thereby enhancing the massaging effect.

20 Claims, 6 Drawing Sheets

SPRAYING HEAD ASSEMBLY FOR MASSAGING TUB

BACKGROUND OF THE INVENTION

1. Field of the Invention

The present invention relates to a spraying head assembly, and more particularly to a spraying head assembly for a massaging tub.

2. Description of the Related Art

A conventional massaging tub in accordance with the prior art shown in FIG. 6 comprises tub body 1 having an inner wall provided with a circulation head 2, a drain head 3 and a plurality of nozzles 4, and a motor 5 mounted in the inside of the tub body 1. The motor 5 is connected to the circulation head 2 through a circulation pipe 6, and is connected to the nozzles 4 through a water outlet pipe 7. When the motor is started, the water contained in the tub body 1 is drawn through the circulation head 2, the circulation pipe 6 and the water outlet pipe 7, and is then injected outward from the nozzles 4, thereby providing a massaging effect. Each of the nozzles 4 is connected to an air guide pipe 8 which introduces the air into the nozzles 4 by the siphon effect, so that the water injected from the nozzle 4 contains air bubbles. The air guide pipe 8 is connected to an air flow regulating valve 9 to regulate the air inlet rate. The drain head 3 is provided with a control valve 3*a* to control operation of the drain head 3.

However, it is necessary to assemble the circulation pipe 6, the water outlet pipe 7 and the air guide pipe 8 in the tub body 1, thereby complicating the assembly process and increasing costs of assembly. In addition, the motor is operated to draw the water contained in the tub body 1 through the circulation head 2, the circulation pipe 6, the water outlet pipe 7 and the nozzles 4, so that the motor needs a larger power, and the water beam injected from the nozzles 4 is weakened. Further, the circulation head 2 is easily choked by an article, such as the towel or the like, so that the circulation head 2 forms a closed state, thereby wearing the motor due to the idling operation.

SUMMARY OF THE INVENTION

The primary objective of the present invention is to provide a spraying head assembly for a massaging tub.

Another objective of the present invention is to provide a spraying head assembly, wherein the water is pressurized by rotation of the helical blades of the vortex rotor and the helical plates of the water outlet valve seat to produce a strong water beam that is injected outward from the nozzle, thereby enhancing the massaging effect.

A further objective of the present invention is to provide a spraying head assembly, wherein the cover has a periphery formed with a plurality of water inlet holes, so that the spraying head assembly will not be blocked or choked by articles, thereby preventing the motor from being worn out due to an idling operation.

A further objective of the present invention is to provide a spraying head assembly, wherein the two water outlet openings of the impulse rotor can co-operate with the transverse bar of the nozzle, so that the water beam injected from the nozzle has an impulse oscillation effect, thereby greatly enhancing the massaging effect.

A further objective of the present invention is to provide a spraying head assembly, wherein each of the two water outlet openings of the impulse rotor has a chamfered face, so that the water pressure can push the impulse rotor to rotate successively.

A further objective of the present invention is to provide a spraying head assembly, wherein the spraying head assembly can be detached from the massaging tub easily and conveniently, thereby facilitating replacement and maintenance of the spraying head assembly.

In accordance with the present invention, there is provided a spraying head assembly, comprising:

a housing having an opened first end and a closed second end;

a cover mounted on the first end of the housing and having a periphery formed with a plurality of water inlet holes;

a water outlet valve seat mounted on the cover and received in the housing;

a water outlet valve cover mounted on the water outlet valve seat and received in the housing;

a vortex rotor rotatably mounted on the water outlet valve seat and received in a space between the water outlet valve seat and the water outlet valve cover;

a bushing mounted in the cover and extended into the cylinder of the water outlet valve seat; and a nozzle rotatably mounted in the bushing.

Further benefits and advantages of the present invention will become apparent after a careful reading of the detailed description with appropriate reference to the accompanying drawings.

DETAILED DESCRIPTION OF THE INVENTION

Figure 1:
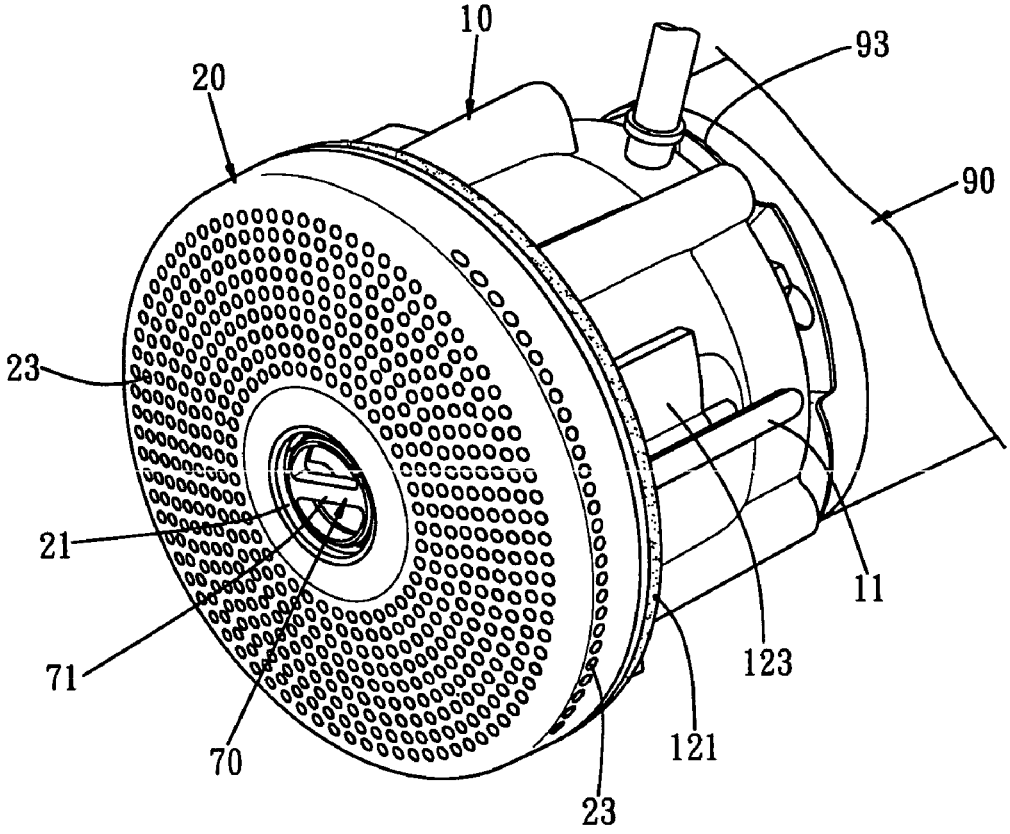
FIG. 1 is a perspective view of a spraying head assembly in accordance with the preferred embodiment of the present invention.

Referring to the drawings and initially to FIGS. 1–4, a spraying head assembly for a massaging tub in accordance with the preferred embodiment of the present invention comprises a housing 10, a cover 20, a water outlet valve seat 30, a water outlet valve cover 40, a vortex rotor 50, a bushing 60, a nozzle 70, an impulse rotor 80, and a motor 90.

The housing 10 is substantially cylindrical shaped, and has a periphery provided with a plurality of semi-circular posts 11. The housing 10 has an opened first end having a periphery formed with an annular lip 12. The housing 10 is provided with an O-ring 121 rested on a side of the lip 12. The housing 10 is provided with a plurality of locking screws 122 each extended through the lip 12, and a plurality of urging plates 123 each screwed on a respective one of the locking screws 122 and each connected to a respective one of the semi-circular posts 11. The lip 12 of the housing 10 is formed with a plurality of locking holes 124 for passage of the locking screws 122. The housing 10 has a closed second end having a center formed with a through hole 13 and having a side formed with an air inlet hole 14 connected to an inside of the housing 10. Preferably, the air inlet hole 14 of the housing 10 is arranged in an oblique manner.

The cover 20 is secured on the lip 12 of the housing 10. The cover 20 has a center formed with a stepped mounting hole 21 having a periphery formed with an annular mounting flange 22. The cover 20 has a periphery formed with a plurality of water inlet holes 23.

The water outlet valve seat 30 is mounted on the cover 20 and received in the housing 10. The water outlet valve seat 30 has a first end provided with a cylinder 31 secured on the mounting flange 22 of the cover 20, and a second end provided with a disk 32. The cylinder 31 of the water outlet valve seat 30 has a bottom face having a center formed with a circular recess 312 having a periphery formed with a plurality of water outlet holes 311. The disk 32 of the water outlet valve seat 30 has an inner face having a center formed with a protruding shaft 322 and having a periphery formed with a plurality of helical plates 321 arranged in a radiating manner.

The water outlet valve cover 40 is secured on the water outlet valve seat 30 and received in the housing 10. The water outlet valve cover 40 has an arcuate shape. The water outlet valve cover 40 has a center formed with a water inlet hole 42 and has a periphery provided with a plurality of support legs 41.

The vortex rotor 50 is rotatably mounted on the water outlet valve seat 30 and received in a space between the water outlet valve seat 30 and the water outlet valve cover 40. The vortex rotor 50 includes a sucker-shaped main body 51 having a first side provided with a hollow mounting post 52 protruded outward from of the main body 51 and mounted on the shaft 322 of the disk 32 of the water outlet valve seat 30 and a second side formed with a square insertion hole 511. The main body 51 of the vortex rotor 50 has a periphery provided with a plurality of helical blades 53.

The bushing 60 is mounted in the mounting hole 21 of the cover 20 and extended into the cylinder 31 of the water outlet valve seat 30. The bushing 60 includes a stepped annular body 61 having a periphery formed with a plurality of elastic plates 62 extended outward, and a rubber ring 622 mounted on the elastic plates 62. Each of the elastic plates 62 of the bushing 60 has an outer wall having a first end formed with a rib 621 located adjacent to the annular body 61 and snapped on an inner face of the mounting hole 21 of the cover 20, and a second end formed with an arc-shaped groove 624 (see FIG. 2*a*) for receiving the rubber ring 622. Each of the elastic plates 62 of the bushing 60 has an inner wall having a distal end formed with a protruding urging edge 623 rested on the vortex rotor 50.

The nozzle 70 is rotatably mounted in the bushing 60 and is elastically retained by the urging edge 623 of each of the elastic plates 62 of the bushing 60. The nozzle 70 is a semi-spherical hollow body, and has an end formed with a transverse bar 71 formed with a protruding shaft 72.

The impulse rotor 80 is mounted in the nozzle 70 and has a center formed with a protruding hollow mounting stud 81 mounted on the shaft 72 of the nozzle 70 and has a periphery formed with two radially opposite water outlet openings 82 each having a chamfered face.

The motor 90 is secured on the second end of the housing 10 by a locking plate 93, and has an end face having a center provided with a square rotation shaft 91 extended through the through hole 13 of the housing 10 and the water inlet hole 42 of the water outlet valve cover 40 and inserted into the insertion hole 511 of the vortex rotor 50. The end face of the motor 90 has a periphery provided with a plurality of threaded rod 92 each screwed into the housing 10.

In assembly, the bushing 60 is mounted in the mounting hole 21 of the cover 20, and the rib 621 of each of the elastic plates 62 of the bushing 60 is snapped on the inner face of the mounting hole 21 of the cover 20, so that the bushing 60 is secured on the cover 20. Then, the impulse rotor 80 is mounted in the nozzle 70, and the mounting stud 81 of the impulse rotor 80 is rotatably mounted on the shaft 72 of the nozzle 70. Then, the nozzle 70 is rotatably mounted in the bushing 60 and is elastically retained by the urging edge 623 of each of the elastic plates 62 of the bushing 60. Then, the cylinder 31 of the water outlet valve seat 30 is secured on the mounting flange 22 of the cover 20, so that the water outlet valve seat 30 is combined with the cover 20. Then, the mounting post 52 of the vortex rotor 50 is mounted on the shaft 322 of the disk 32 of the water outlet valve seat 30, so that the vortex rotor 50 is rotatably mounted on the water outlet valve seat 30. Then, the water outlet valve cover 40 is secured on the water outlet valve seat 30, so that the vortex rotor 50 is rotatably mounted between the water outlet valve seat 30 and the water outlet valve cover 40. Then, the cover 20 is secured on the lip 12 of the housing 10. Finally, the motor 90 is secured on the second end of the housing 10 by a locking plate 93, and the rotation shaft 91 of the motor 90 is extended through the through hole 13 of the housing 10 and the water inlet hole 42 of the water outlet valve cover 40 and inserted into the insertion hole 511 of the vortex rotor 50.

Figures 2, 2A:
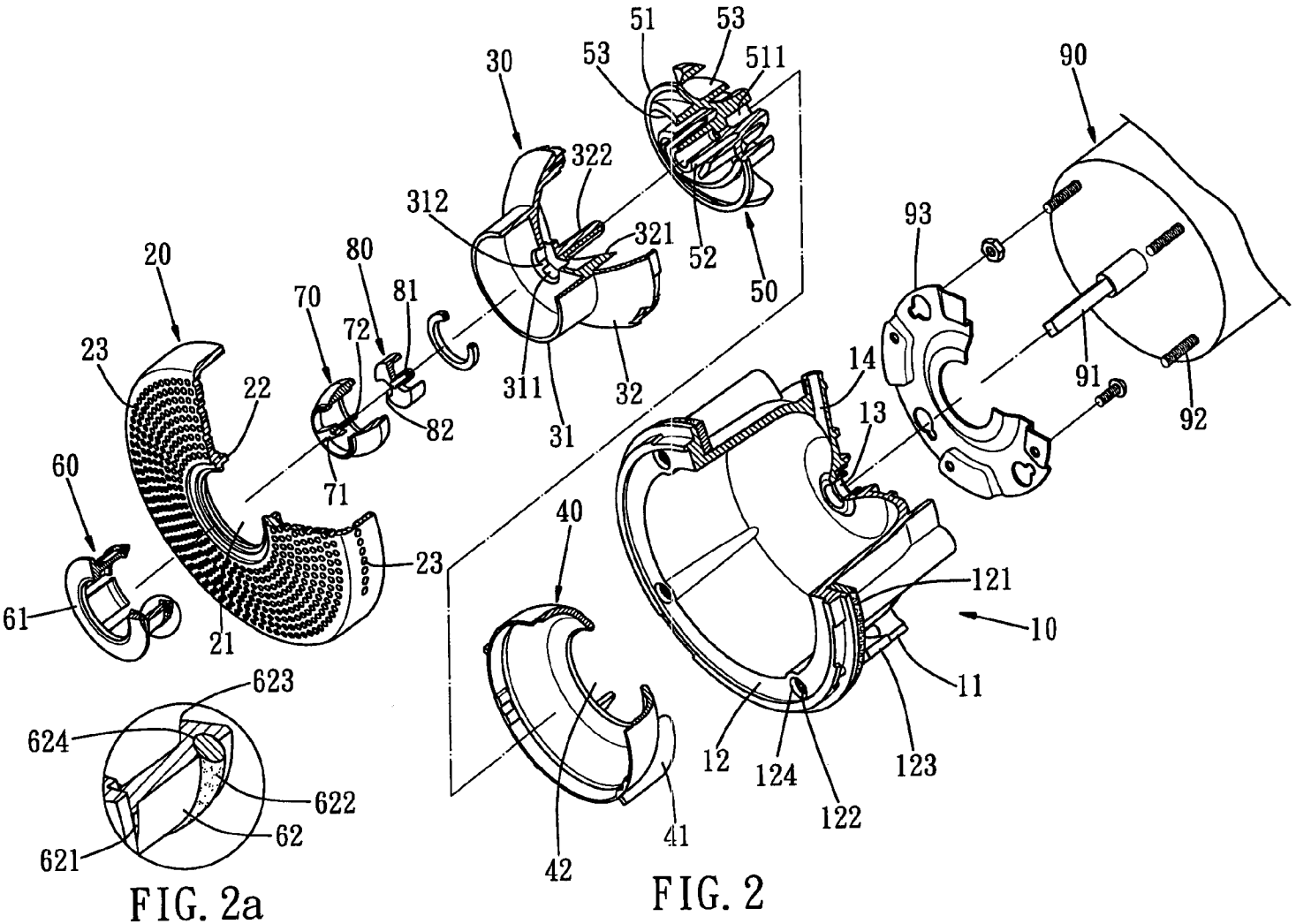
FIG. 2 is an exploded perspective view of the spraying head assembly in accordance with the preferred embodiment of the present invention.
FIG. 2*a* is a partially enlarged cross-sectional view of the spraying head assembly as shown in FIG. 2.
Figure 3:
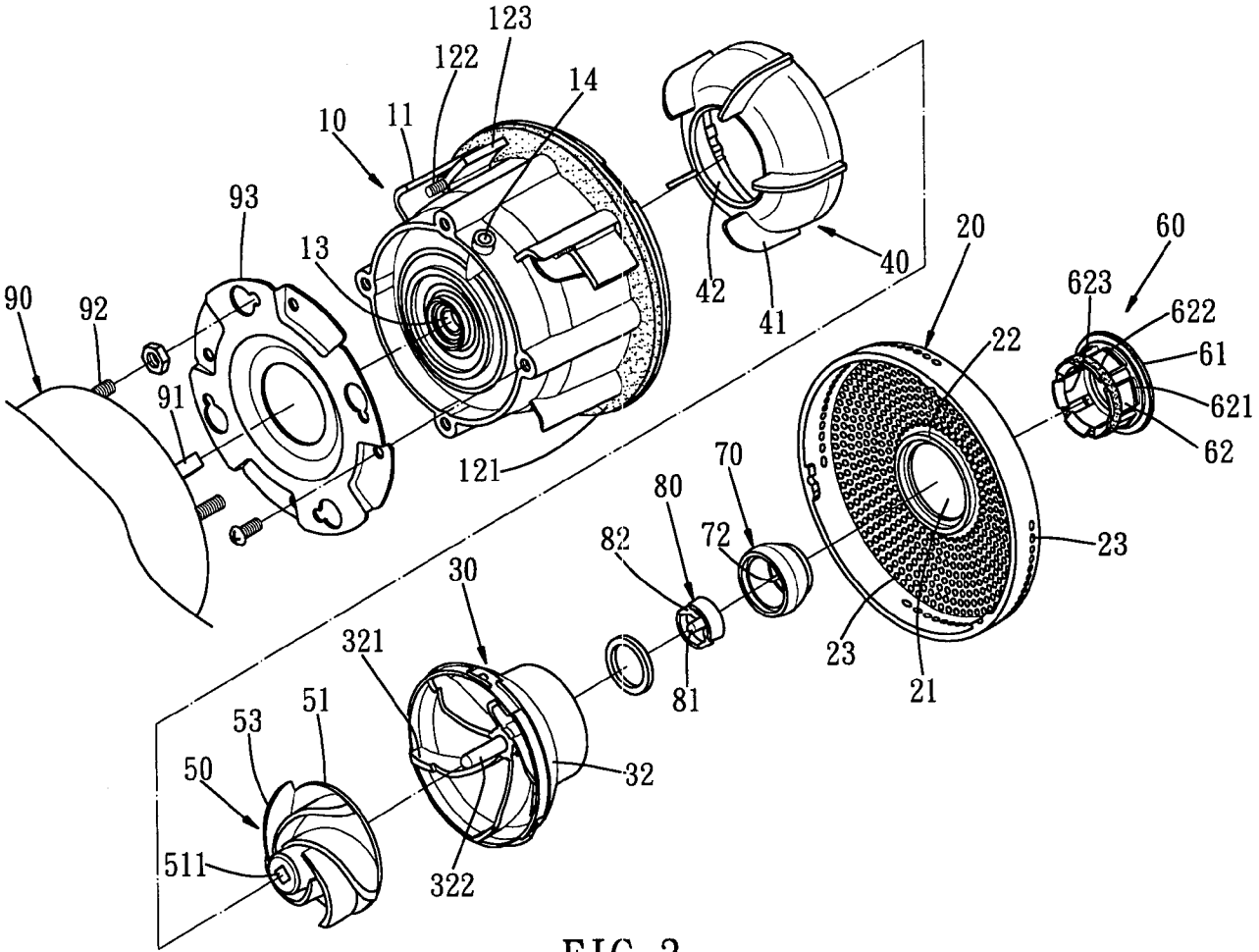
FIG. 3 is an exploded perspective view of the spraying head assembly in accordance with the preferred embodiment of the present invention.
Figure 4:
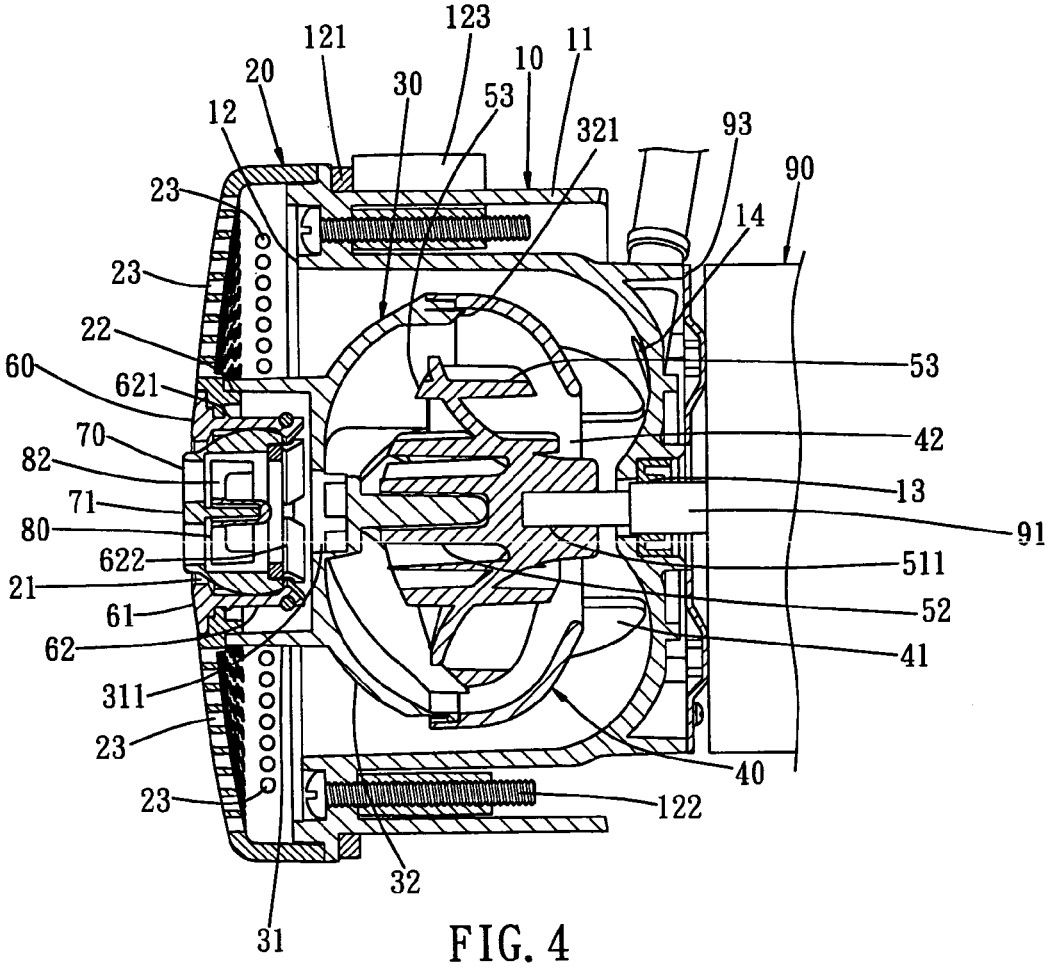
FIG. 4 is a side plan cross-sectional view of the spraying head assembly as shown in FIG. 1.
Figure 5:
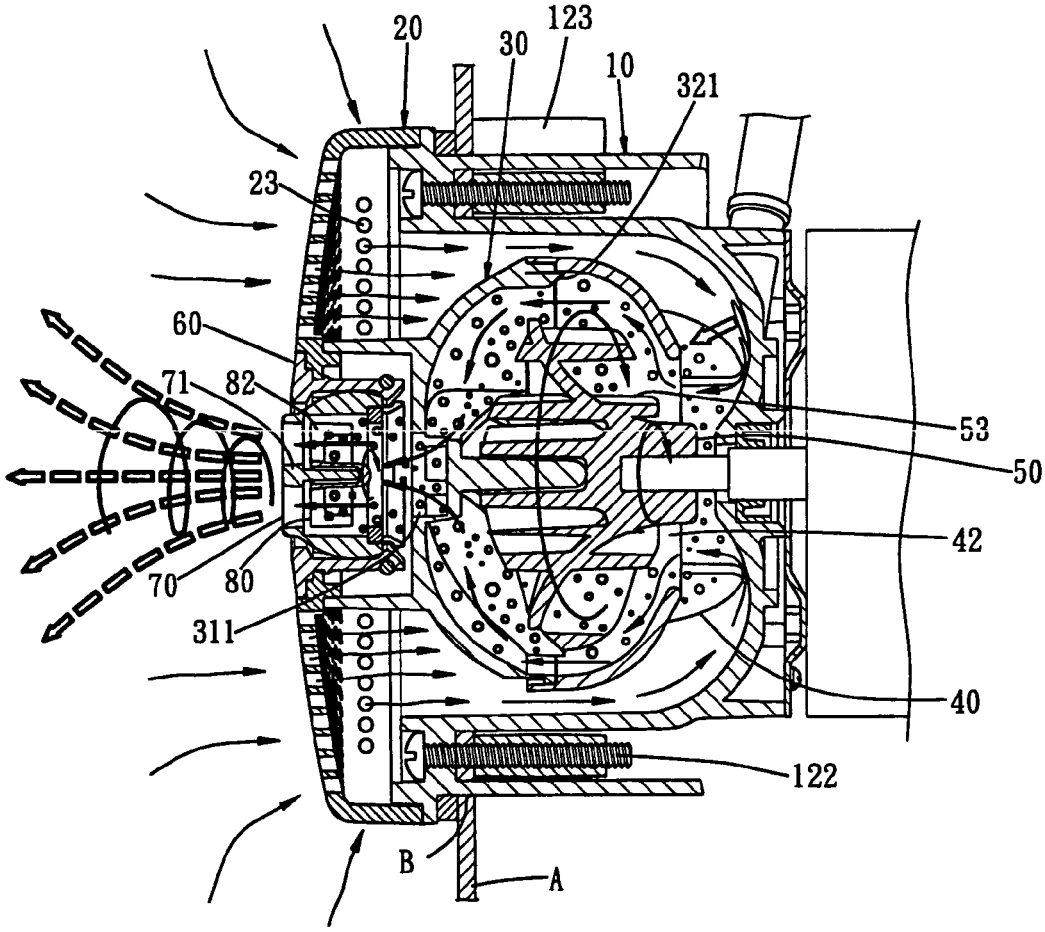
FIG. 5 is a schematic operational view of the spraying head assembly as shown in FIG. 4 in use.
Figure 6:
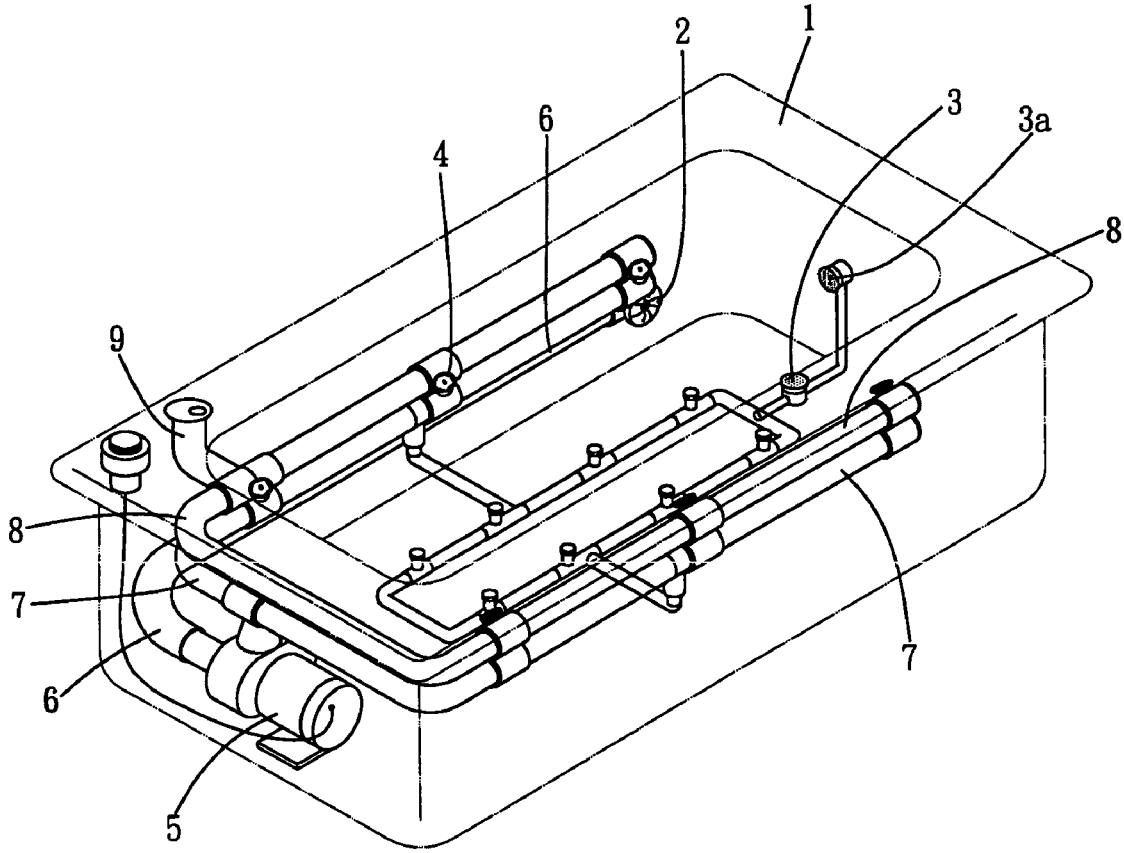
FIG. 6 PRIOR ART
FIG. 6 is a perspective view of a conventional massaging tub in accordance with the prior art.

In operation, referring to FIGS. 4 and 5 with reference to FIGS. 1–3, the housing 10 of the spraying head assembly is mounted in a fitting hole B of the inner wall A of the massaging tub. Then, the locking screws 122 are rotated to drive the urging plates 123 to press the inner wall A of the massaging tub, so that the housing 10 is fixed on the inner wall A of the massaging tub. Then, the rotation shaft 91 of the motor 90 is rotated to drive the vortex rotor 50 to rotate therewith, thereby forming a suction force to suck the water contained in the massaging tub to flow through the water inlet holes 23 of the cover 20 into the housing 10, and to flow through the water inlet hole 42 of the water outlet valve cover 40 into the water outlet valve seat 30 and the water outlet valve cover 40. Then, the water contained in the water outlet valve seat 30 and the water outlet valve cover 40 is pressurized by rotation of the helical blades 53 of the vortex rotor 50 and the helical plates 321 of the water outlet valve seat 30 and is then driven to flow through the water outlet holes 311 of the water outlet valve seat 30 into the nozzle 70 to push and rotate the impulse rotor 80, thereby producing a strong water beam that is injected outward from the nozzle 70 through the two water outlet openings 82 of the impulse rotor 80, so as to provide a massaging effect.

In addition, each of the two water outlet openings 82 of the impulse rotor 80 has a chamfered face, so that the water pressure can push the impulse rotor 80 to rotate successively. Further, when the two water outlet openings 82 of the impulse rotor 80 are rotated to align with the transverse bar 71 of the nozzle 70, the water beam is stopped by the transverse bar 71 of the nozzle 70, so that the water beam has an impulse oscillation effect. Further, the air is introduced through the air inlet hole 14 of the housing 10 into the housing 10 by the siphon effect, so that the water injected from the nozzle 70 contains air bubbles.

Accordingly, the spraying head assembly of the present invention has the following advantages.

1. The water is pressurized by rotation of the helical blades 53 of the vortex rotor 50 and the helical plates 321 of the water outlet valve seat 30 to produce a strong water beam that is injected outward from the nozzle 70, thereby enhancing the massaging effect.

2. The cover 20 has a periphery formed with a plurality of water inlet holes 23, so that the spraying head assembly will not be blocked or choked by articles, thereby preventing the motor 90 from being worn out due to an idling operation.

3. The two water outlet openings 82 of the impulse rotor 80 can co-operate with the transverse bar 71 of the nozzle 70, so that the water beam injected from the nozzle 70 has an impulse oscillation effect, thereby greatly enhancing the massaging effect.

4. Each of the two water outlet openings 82 of the impulse rotor 80 has a chamfered face, so that the water pressure can push the impulse rotor 80 to rotate successively.

5. The spraying head assembly can be detached from the massaging tub easily and conveniently, thereby facilitating replacement and maintenance of the spraying head assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying head assembly, comprising:

a housing having an opened first end and a closed second end;

a cover mounted on the first end of the housing and having a periphery formed with a plurality of water inlet holes;

a water outlet valve seat mounted on the cover and received in the housing;

a water outlet valve cover mounted on the water outlet valve seat and received in the housing;

a vortex rotor rotatably mounted on the water outlet valve seat and received in a space between the water outlet valve seat and the water outlet valve cover;

a bushing mounted in the cover and extended into a cylinder of the water outlet valve seat; and a nozzle rotatably mounted in the bushing.

2. The spraying head assembly in accordance with claim 1, wherein the opened first end of the housing has a periphery formed with an annular lip, and the cover is secured on the lip of the housing.

3. The spraying head assembly in accordance with claim 2, wherein the housing is provided with an O-ring rested on a side of the lip.

4. The spraying head assembly in accordance with claim 2, wherein the housing has a periphery provided with a plurality of semi-circular posts, the housing is provided with a plurality of locking screws each extended through the lip, and a plurality of urging plates each screwed on a respective one of the locking screws and each connected to a respective one of the semi-circular posts.

5. The spraying head assembly in accordance with claim 1, wherein the lip of the housing is formed with a plurality of locking holes for passage of the locking screws.

6. The spraying head assembly in accordance with claim 1, wherein the cover has a center formed with a stepped mounting hole for mounting the bushing.

7. The spraying head assembly in accordance with claim 6, wherein the mounting hole of the cover has a periphery formed with an annular mounting flange, and the water outlet valve seat has a first end provided with the cylinder secured on the mounting flange of the cover.

8. The spraying head assembly in accordance with claim 7, wherein the cylinder of the water outlet valve seat has a bottom face having a center formed with a circular recess having a periphery formed with a plurality of water outlet holes.

9. The spraying head assembly in accordance with claim 1, wherein the water outlet valve seat has a second end provided with a disk having an inner face having a center formed with a protruding shaft, and the vortex rotor is rotatably mounted on the disk of the water outlet valve seat and has a first side provided with a hollow mounting post mounted on the shaft of the disk of the water outlet valve seat.

10. The spraying head assembly in accordance with claim 9, wherein the disk of the water outlet valve seat has a periphery formed with a plurality of helical plates arranged in a radiating maimer.

11. The spraying head assembly in accordance with claim 9, wherein the main body of the vortex rotor has a periphery provided with a plurality of helical blades.

12. The spraying head assembly in accordance with claim 1, wherein the bushing includes a stepped annular body having a periphery formed with a plurality of elastic plates extended outward, and a rubber ring mounted on the elastic plates.

13. The spraying head assembly in accordance with claim 12, wherein each of the elastic plates of the bushing has an outer wall having a first end formed with a rib located adjacent to the annular body and snapped on an inner face of the cover, and a second end formed with an arc-shaped groove for receiving the rubber ring.

14. The spraying head assembly in accordance with claim 12, wherein each of the elastic plates of the bushing has an inner wall having a distal end formed with a protruding urging edge, and the nozzle is elastically retained by the urging edge of each of the elastic plates of the bushing.

15. The spraying head assembly in accordance with claim 1, wherein the nozzle has an end formed with a transverse bar formed with a protruding shaft, and the spraying head assembly further comprises an impulse rotor mounted in the nozzle and having a center formed with a protruding hollow mounting stud mounted on the shaft of the nozzle.

16. The spraying head assembly in accordance with claim 15, wherein the impulse rotor has a periphery formed with two radially opposite water outlet openings each having a chamfered face.

17. The spraying head assembly in accordance with claim 1, wherein the closed second end of the housing has a center formed with a through hole, the water outlet valve cover has a center formed with a water inlet hole, the vortex rotor has a second side formed with a square insertion hole, and the spraying head assembly further comprises a motor secured on the second end of the housing and having an end face having a center provided with a square rotation shaft extended through the through hole of the housing and the water inlet hole of the water outlet valve cover and inserted into the insertion hole of the vortex rotor.

18. The spraying head assembly in accordance with claim 1, wherein the closed second end of the housing has a side formed with an air inlet hole connected to an inside of the housing and arranged in an oblique manner.

19. The spraying head assembly in accordance with claim 1, wherein the water outlet valve cover has an arcuate shape and has a periphery provided with a plurality of support legs.

20. The spraying head assembly in accordance with claim 1, wherein the nozzle is a semi-spherical hollow body.

* * * * *